US006684915B1

(12) United States Patent
Ver Hage

(10) Patent No.: US 6,684,915 B1
(45) Date of Patent: Feb. 3, 2004

(54) MULTIPLE HEAD BOTTLE FILLING APPARATUS AND METHOD

(75) Inventor: Richard P. Ver Hage, North Haledon, NJ (US)

(73) Assignee: Ver Hage Enterprises, Inc., Midland Park, NJ (US)

( * ) Notice: Subject to any disclaimer, the term of this patent is extended or adjusted under 35 U.S.C. 154(b) by 0 days.

(21) Appl. No.: 10/266,796

(22) Filed: Oct. 8, 2002

(51) Int. Cl.[7] ..... B65B 3/04

(52) U.S. Cl. ..... 141/2; 141/99; 141/237; 141/246; 141/248; 141/302

(58) Field of Search ..... 141/2, 235, 236, 141/237, 242, 243, 244, 246, 248, 99, 285, 301, 302

(56) References Cited

U.S. PATENT DOCUMENTS 596,813 A * 1/1898 Ihrig ..... 141/246
5,305,809 A * 4/1994 Pringle ..... 141/235

* cited by examiner

*Primary Examiner*—Gregory Huson
*Assistant Examiner*—Peter deVore
(74) *Attorney, Agent, or Firm*—W. Patrick Quast, Esq.

(57) ABSTRACT

A multiple head bottle filling apparatus and method for filling bottles used in animal feeding. Manifold assemblies designed for filling bottles disposed in at least two differently sized trays is easily removably affixed to the rear back splash of the filling apparatus. Each manifold assembly includes a respective set of liquid discharging members, including openings arranged in a respective grid pattern. Each grid pattern corresponds to the bottle opening, alignment pattern for each differently sized tray. The respective grid patterns of the liquid discharging members are in fixed relationship to each other. Liquid feed lines, manually or automatically activated, supply liquid for bottle filling to a respective one of the manifold assemblies and, in turn, the respective set of liquid discharging members. As differently sized trays containing bottles are presented at the bottle filling apparatus, the bottles are filled by a respective set of liquid discharging members, by registering the tray position in relation to the respective grid pattern. If circumstances require, the bottle filling apparatus and methodology can accommodate additional bottle-containing, tray configurations with appropriately arranged discharge opening, grid patterns as part of one assembly or additional, detachably connected assemblies.

12 Claims, 6 Drawing Sheets

MULTIPLE HEAD BOTTLE FILLING APPARATUS AND METHOD

This invention relates to multiple bottle liquid filling devices, and in particular to devices for liquid filling bottles employed for animal feeding.

BACKGROUND

Over time a wide variety of bottles have been used for animal feeding. Originating with dairy bottles, today multiple glass configurations and polycarbonate and other plastics are routinely employed. Liquids for animal feeding comprise primarily water, with options of course, for adding nutrients, drugs, and various sterilizing agents. Filling these differently shaped bottles for use in various animal cage structures can vary from hand filling operations to fully automated procedures depending on requirements. Although the bottles can be filled one at a time using a hose or spigot, usually some kind of manifold arrangement is utilized to fill the bottles.

While manifold bottle filling devices provide operators with convenience and speed, by their nature they are a "locked-in" design, generally accommodating only one particular bottle size and basket configuration. The present invention addresses this problem by providing for the use of a combined, multiple manifold assembly arrangements in order to rapidly and efficiently accommodate frequently occurring multiple sized bottle filling operations.

It is therefore a primary object of the invention to provide a convenient and economical system and method for liquid filling at least two differently sized bottle arrangements in rapid succession.

An additional object of the invention is to provide a flexible manifold system and method for liquid filling of bottles.

Still another object of the invention is to provide for the quick connection and disconnection of at least a two manifold arrangement for the liquid filling of differently sized bottles.

A further object of the invention is to provide a system and method for filling a quantity of at least two differently sized bottles contained in first and second bottle baskets without the normal necessity for manifold replacement.

Yet another object of the invention is to provide a system and method for manual liquid filling of at least two different sized bottles contained in at least a first and second bottle basket in immediately following consecutive order.

Still another object of the invention is to provide a system for automatic liquid filling of at least two different sized bottles contained in at least a first and second tray in immediately following consecutive order.

SUMMARY

These and other objects are obtained with the multiple head, bottle filling apparatus and method of the present invention.

As mentioned above routine liquid filling a quantity of bottles for animal feeding generally makes use of a manifold for delivering a pre-determined quantity of liquid into a number of same sized bottles arranged in a basket or tray. Bottles may be filled with ordinary tap water, purified water, or water having added nutrients or pharmaceuticals. For a variety of reasons differently sized bottles are often introduced into animal feeding. With prior art filling arrangement this may necessitate buying additional bottle filling stations with obvious negative cost and space disadvantages; or more commonly, substituting a second manifold to alternate with an existing manifold. This later option is the one most often resorted to. It requires the operator, however, to organize the bottle baskets so that a succession of baskets of the same size and bottle arrangement are collected together. These are all filled before the manifold is replaced to accommodate a second grouping of differently sized baskets.

Attempts have been made to simplify alternate manifold attachments, such as, for example, a quick-release manifold holder attached to the control cabinet of a bottle filling station. While this holder provides added convenience, it occurred that substantial time savings would result if an alternate filling means could be simultaneously available so as to immediately fill bottles irrespective of their arrangement or order in a bottle-filling line.

To this end a bottle filling apparatus is constructed, including a multiple head, manifold assembly which is supported in a suitable manner in order to fill a horizontally disposed, basket of bottles. These may be arranged in a variety of configured baskets. However for purposes of illustration and not by way of limitation, the principles of the invention will be discussed as they are implemented for two such basket configurations.

A typical embodiment includes the securing of the manifold assembly to a back plash which is vertically positioned above the water filling station. A quick-release manifold holder is secured to this back splash. In the particular example to be described, in which the first manifold assembly is designed to fill 24 bottles at one time, a first bottle filling grid system is employed. It utilizes six, first manifold tubes, capped at one end, and attached to the manifold base. These tubes extend outward from and typically perpendicular to the manifold base. A set of four nipples extend downward from each tube. The manifold base, manifold tubes, and nipples are hollow and confluent with each other. A liquid feed line is attached at the center of the manifold base, generally extending upward and parallel to the back splash. Each of the 24 nipples is disposed at a respective intersection in a first grid system where a particular bottle opening will be positioned.

To efficiently accommodate a second bottle basket configuration, as, for example, 20 bottles, typically different in size from the 24 bottle arrangement, and disposed in a differently sized basket, a second bottle filling grid system is employed. It utilizes a second manifold assembly set in place in fixed relationship to the first manifold. The second manifold base may be secured to the first manifold base, such as by welding the two together. This second manifold assembly, in turn, has a second liquid feed line with an in-line valve attached. For this specific bottle basket configuration, five, second manifold tubes, are capped on one end, and attached to the second manifold base. These tubes extend outward from and typically are perpendicular to the second manifold base. A set of four, second nipples extend downward from each second manifold tube, for a total of twenty. The nipples, second manifold tubes, and second manifold base are hollow and confluent with each other. These second set of tubes with their respective set of nipples are positioned immediately adjacent and between the first set of tubes and their respective set of first nipples. Each of the twenty nipples is disposed at a respective intersection in the second grid system where a particular bottle opening, for the 20 bottle configuration, will be positioned. Although not necessary and not always the case, the second set of nipples can have sufficient length so as to have their openings at the same height above the fill table as the openings in the first set of nipples.

In operation, a tray, in this example containing 20 or 24 bottles, would be placed on suitable support rods within the fill table. This placement would be registered to the respective nipple opening grid system so that each bottle opening is positioned beneath one of the downwardly extending nipples for that respective grid system. The liquid feed line (which is connected to a source of liquid, for example, purified water) of the respective manifold assembly is then activated either by manually turning an in-line valve on and visually monitoring the fill process, or automatically by means of a solenoid-activated, in-line valve, controlled by a timer.

With the above arrangement it becomes possible to conveniently process bottle baskets of different bottle size and/or configuration as they become available instead of the prior practice of accumulating a number of trays, changing a manifold, and then processing the subsequent tray configuration. In addition, the present invention also provides a method and apparatus for rapid replacement of the manifolds with another set, to handle still further tray configurations, if that becomes necessary.

It is anticipated that with suitable positioning of associated hardware in relation to the first and second grid systems, additional grid systems can be configured so as to properly position the respective sets of nipples in their own unique grid patterns to fill bottles arranged in still other basket configurations, without changing the manifold assembly.

Alternatively, with the quick release feature different manifold assembly configurations designed to fill still other bottle basket arrangements can be utilized.

The fill table, back splash, manifold assemblies, and liquid feed lines implementing the invention can, of course, be fabricated in a variety of materials, including metals such as aluminum and stainless steel, plastics, or glass, depending on requirements. Since sterilizing agents, such as dilute acids, and/or chlorine may be introduced into the liquid feed, type 316 stainless steel is often the preferred material of construction, at least for some of the above components, to minimize possible corrosion.

DESCRIPTION OF THE PREFERRED EMBODIMENT

Figure 1:
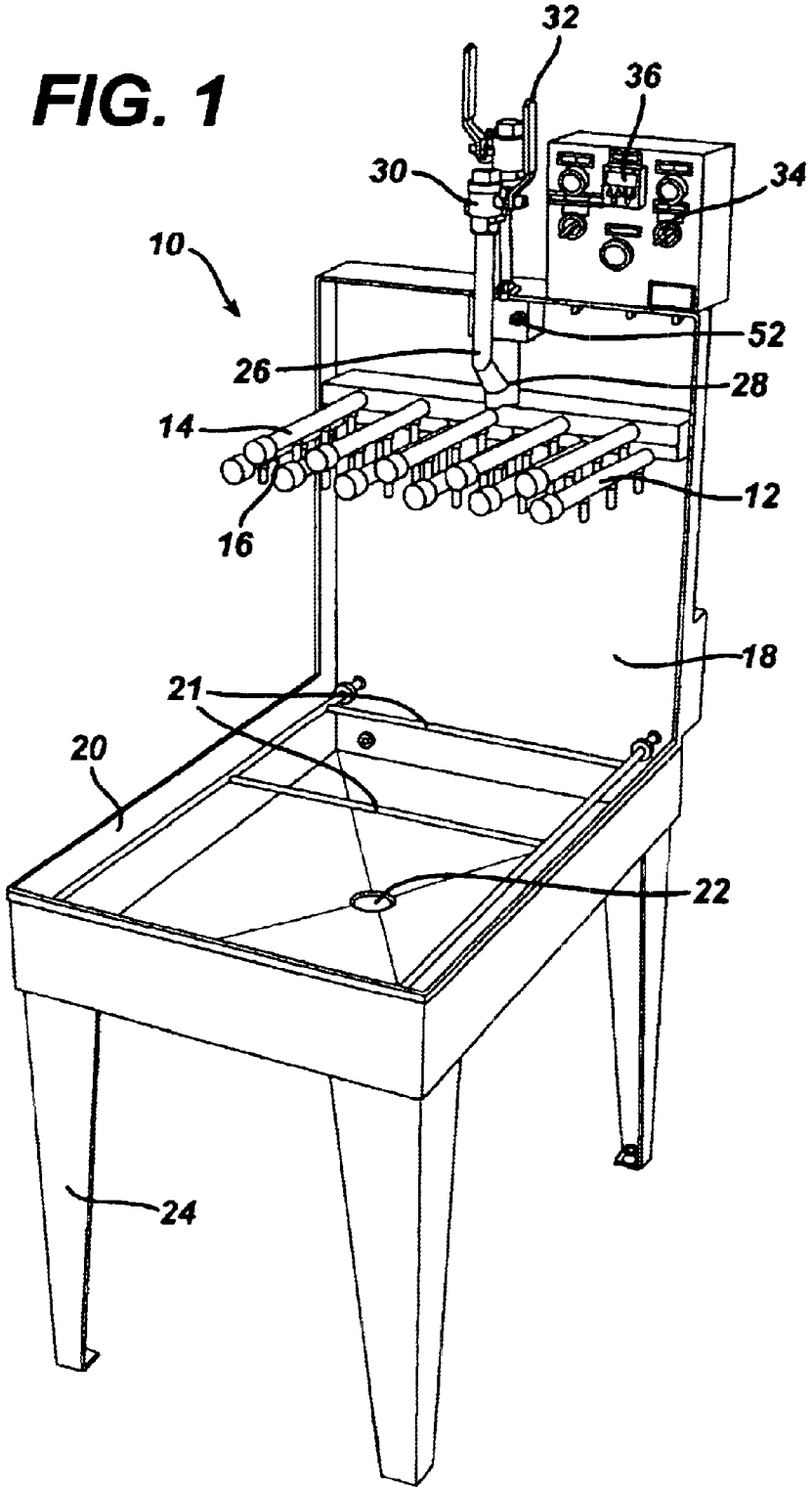
FIG. 1 is a perspective view of one version of the bottle filling apparatus of the invention, illustrating a dual manifold system in place within the station.

Turning now to the drawings in which similar structures having the same function are denoted with the same numerals, in FIG. 1 a version of the bottle filling apparatus 10 of the invention is shown. The apparatus 10 is comprised of a fill table 20 supported on four legs 24. A liquid drain 22 is positioned centrally within the fill table. Two support rods 21 extend laterally across the top edge of the rectangularly shaped fill table. At a rear edge of the fill table 20 a back splash 18 extends upward and generally perpendicular to the fill table. The function of the back splash is to provide a convenient area for mounting the combined manifold assemblies (45, 51—FIGS. 3 and 4), liquid feed lines 26, 28, and additional controls and equipment such as solenoid valves 34 and timer 36. Typical dimensions for a bottle filling apparatus can be 50" H×30" W×40" D. While a bottle filling apparatus can be fabricated in a variety of materials, such as aluminum, or plastics such as polycarbonate, the nature of animal feeding stations tends to favor stainless steel, as, for example, type 316 stainless steel, at least for certain of the components. Corrosive materials such as dilute acids and/or chlorine may be used as sterilizing agents, and the general high sanitary standards required favor this material.

Figure 3:
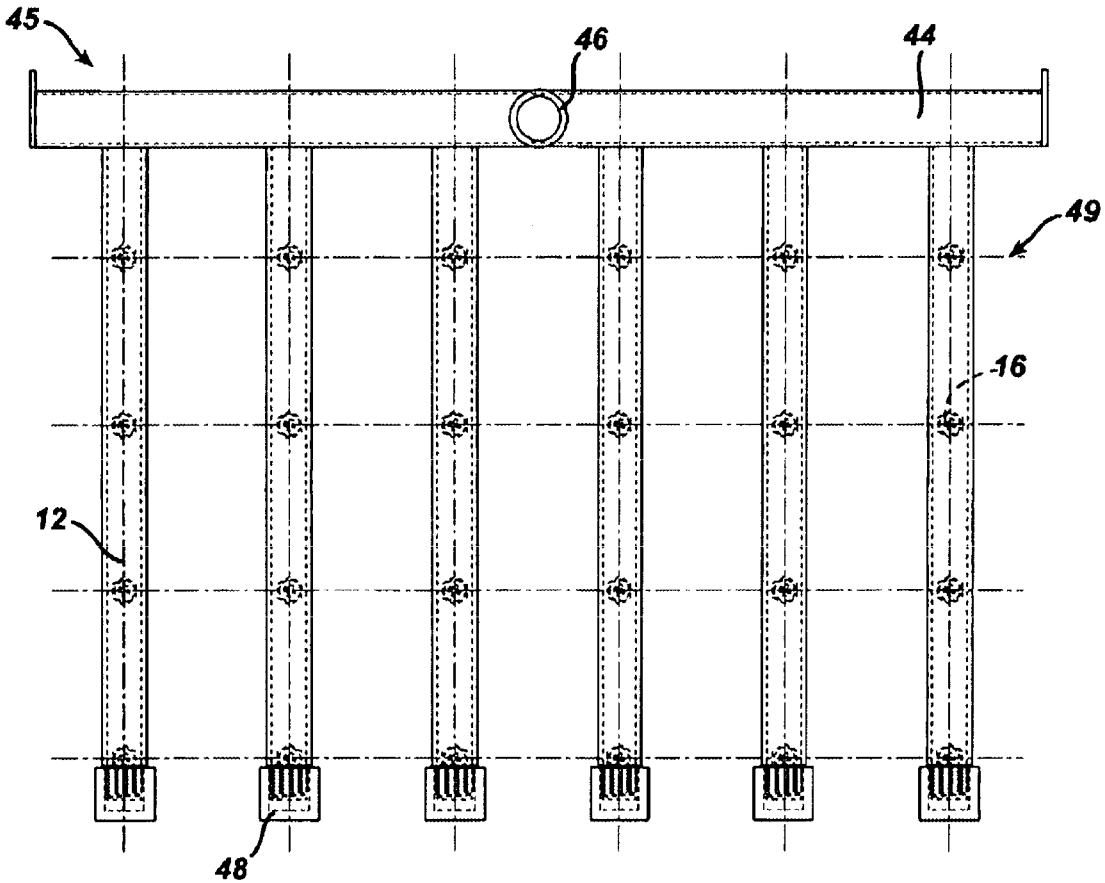
FIG. 3 is a schematic, top plan view of one version of a first manifold component of the invention.
Figure 4:
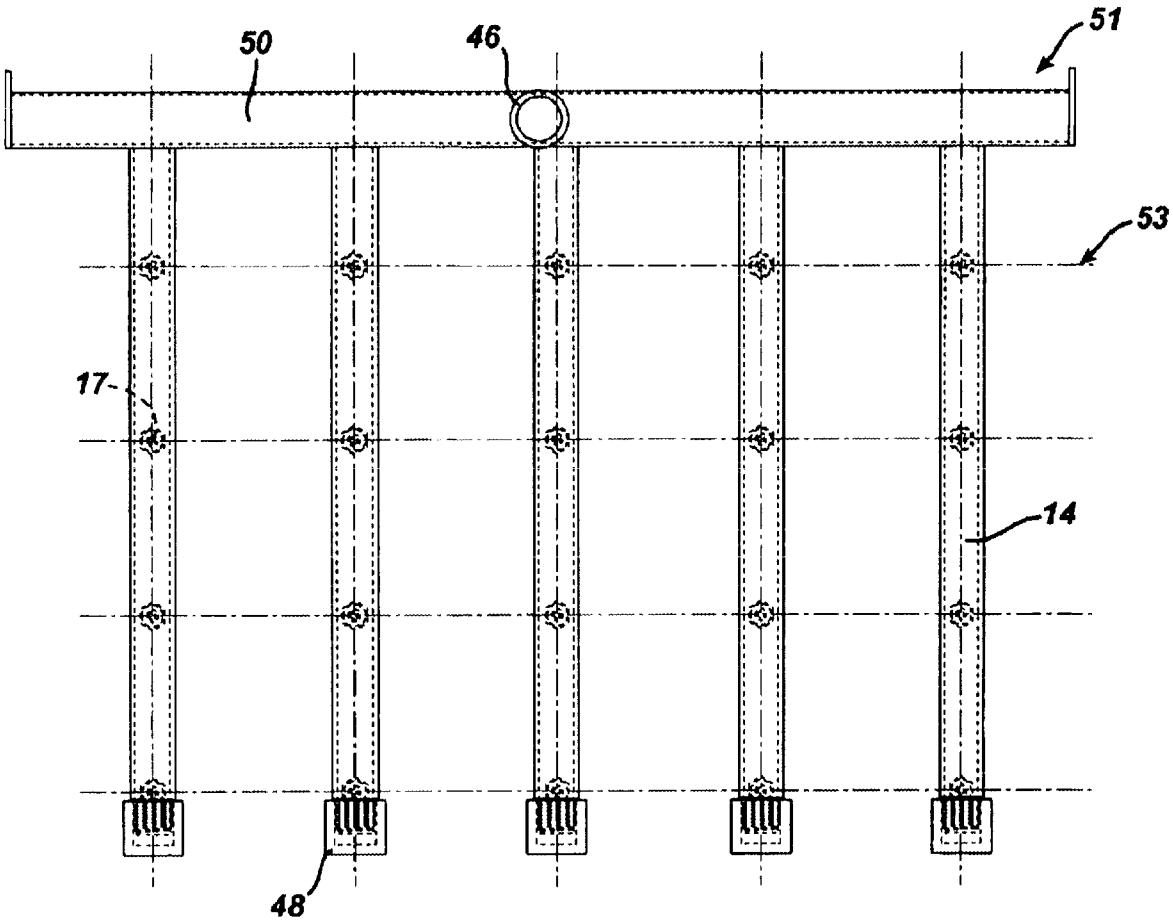
FIG. 4 is a schematic, top plan view of one version of a second manifold component of the invention.

As previously noted, manifold assemblies 45, 51 are the present preferred structures in accordance with the principles of this invention for dispensing water and other liquids into appropriate bottles used in animal feeding. FIGS. 3 and 4 illustrate two typical manifold assembly constructions. In FIG. 3 a twenty four nipple, manifold assembly 45 is depicted. The manifold base 44 has six manifold tubes 12 extending outwards, perpendicular to the base and parallel to each other. Each of the tubes is capped 48 at its free end. Twenty-four nipples 16, shown in phantom, extend downward from the manifold tubes 12. Four tube nipples 16 extend from each one of the six manifold tubes. A first grid system 49 of nipples is formed such that the nipple openings are positioned where the corresponding openings to the bottles will be located for the respective bottle basket or tray, here e.g., the twenty-four bottle configuration.

Figure 5:
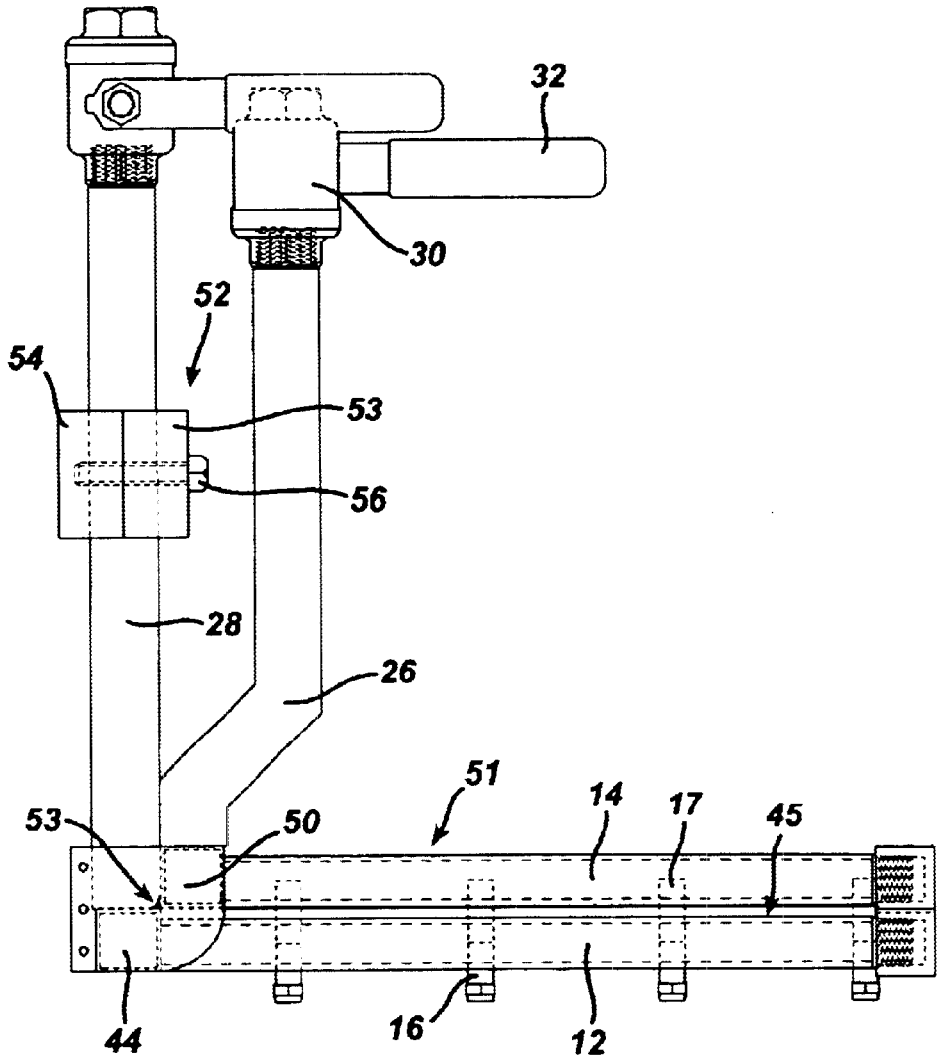
FIG. 5 is a schematic side elevational view of one version of a first and second manifold in place within the bottle filling apparatus of the invention.

In FIG. 4 a twenty nipple manifold assembly 51 is shown. In this construction, a manifold base 50 has five manifold tubes 14, each with four tube nipples 17 similarly positioned to that of the construction of the twenty four nipple manifold 45. A central opening 46 in both manifold bases provides for the connection of the liquid feed lines 26, 28 (FIG. 5). A second grid system 53 of nipples 17 is formed such that the nipple openings are positioned where the corresponding openings to the bottles will be located for this bottle basket arrangement, i.e. the twenty bottle configuration.

Type 316 stainless steel is a preferred material of fabrication for these manifold assemblies, although, again, for some or all of the components, other materials can be used, such as aluminum, plastic, glass, copper, etc.

In FIGS. 1 and 5, a quick-release manifold assembly holder 52 is shown affixed to the back splash 18. The holder 52 (FIG. 5) is comprised of two blocks, a first block 54 being typically, permanently affixed (by welding, adhesive, bolts, etc., not shown) to the back splash 18. A second block 53 is removably attached to the first block, such as by means of a screw 56, or hinge and suitable locking mechanism to secure 53 to 54.

Figure 6:
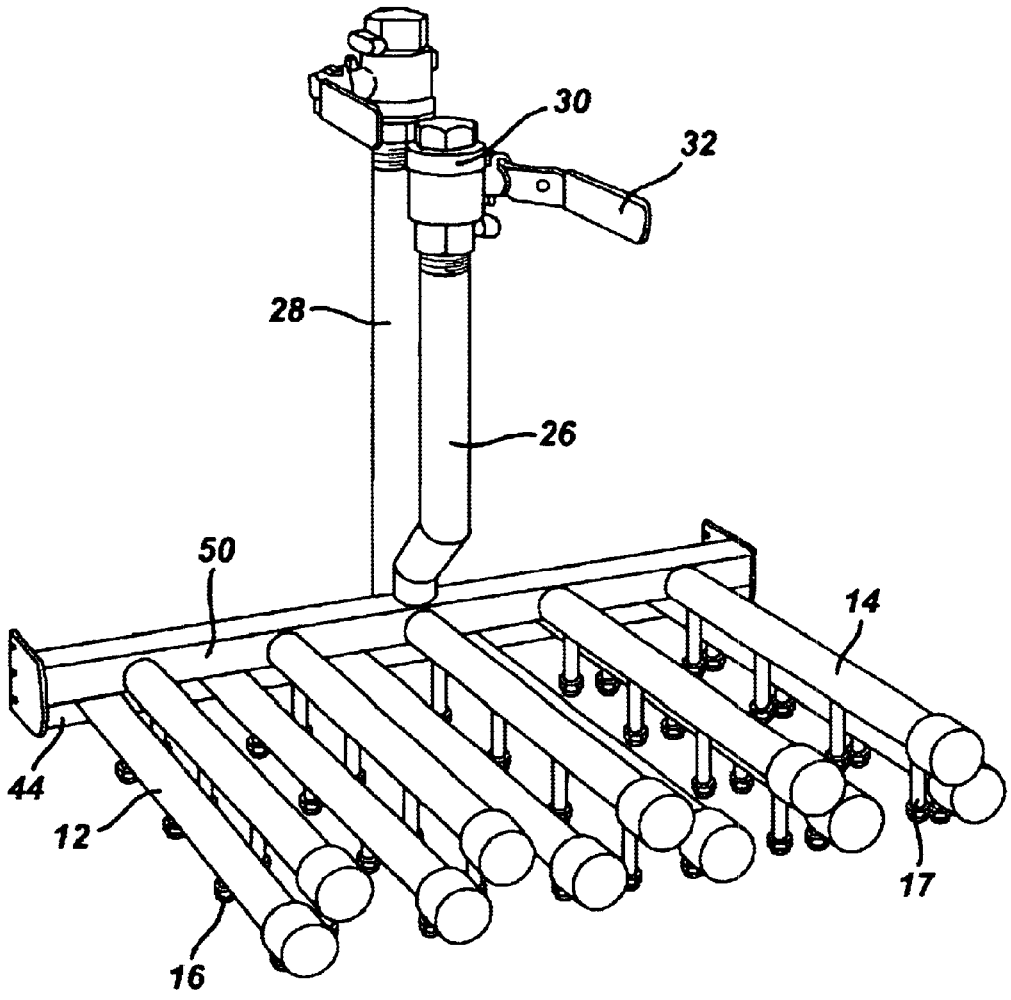
FIG. 6 is a perspective view of one version of a first and second manifold assembly in place within the invention.

As best seen in FIGS. 5 and 6, the preferred embodiment of the present invention provides for placing the second manifold assembly SI directly above the first assembly manifold 45. The manifold base 50 of this second manifold assembly 51 can have the same dimensions as the first manifold base 44. The liquid feed line 26 is positioned in close proximity to the liquid feed line 28. Manifold base 50 is secured to the first manifold base 44 at the seam 53 such as by welding, etc. The five manifold tubes 14 extend outward from the base 50 and are positioned in the space between respective manifold tubes 12 of the first manifold assembly 45. The twenty, downwardly projecting nipples 17 are positioned along the length of the tubes 14 so as to locate their openings where required to match the bottle openings for match the openings in bottles 38 as arranged in their tray. A second liquid feed line 26 connects to this second manifold assembly, and is regulated with the appropriate in-line valve 30. Both feed lines 26, 28 continue on (not shown) to a central liquid supply.

Figure 2:
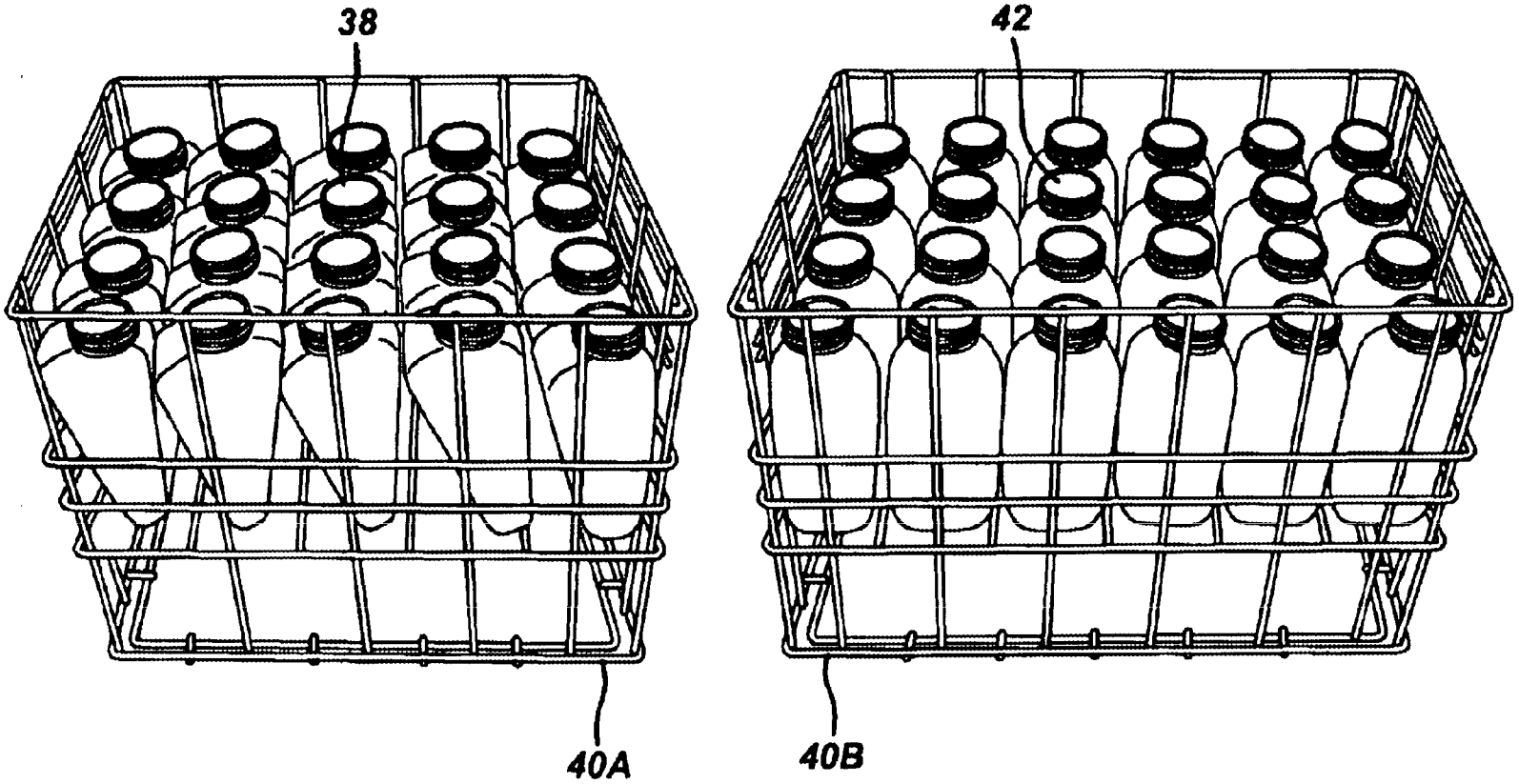
FIG. 2 is a perspective view of two trays of different sized bottles ready to be processed by one version of the bottle filling apparatus of the invention.

FIG. 2 illustrates an example of the situational problem to which this invention is addressed. A first tray or bottle basket 40A is shown holding twenty bottles 38 of one size and configuration. A second tray 40B holds twenty-four bottles 42 of a different size and shape.

In the manual operation depicted in FIG. 5, a tray (40A or 40B) (not shown in this view) filled with bottles (38 or 42) is placed on the support rods 21 within the fill table. The specific tray is registered (manually or automatically, if, for example, a conveyor belt tray feed is employed) to the nipple grid pattern or layout for the particular manifold assembly to be used in filling the bottles. Turning the appropriate in-line valve handle 32 "on" now permits filling each bottle with liquid, the procedure being monitored by an operator. The procedure can, of course, be automated using a solenoid valve 34 and timer 36 connected to the electrically operated, in-line solenoid valve. Water level sensing devices presently available, can also be used to control the fill level of the bottles. For high volume operations tray conveyer systems with optical or electrical recognition techniques for discerning the differing bottle sizes can also be employed. These can be synchronized with the in-line valves and timer or water level, sensing devices.

When necessary, the manifold system can be removed from the apparatus 10 (FIG. 1) by simply opening the manifold holder 52, and then disconnecting the connected liquid feed line 26 from the in-line valve 30, and replacing this particular manifold assembly system with another manifold assembly system.

Thus it can be seen that the multiple head bottle filling apparatus of the invention provides important new conveniences in animal feeding stations. Cumbersome manifold changing operations can be entirely eliminated, while providing for maximum flexibility in dealing with multiple size bottle filling requirements.

While the present invention has been disclosed in connection with versions shown in detail, various modifications and improvements will become readily apparent to those skilled in the art. So, for example, the mounting block 54 of the manifold assembly holder 52 could be secured to a wall surface. Also, instead of separate in-line valves, whether manually or electrically operated, a three-way valve with a neutral, position, could be employed. Further, the fill table could be avoided by placing the bottle basket on a dolly stand and wheeling it under the nipple arrangement, being careful to align the bottle openings under the appropriate nipple grid system. And still further, while in-line valves are disclosed to control water flow in a particular feed line, this could as well be accomplished by routing the feed lines to a respective water pump, connected to a water reservoir. By then activating the respective pump, water is made to flow through its feed line and nipple grid arrangement, into the positioned bottles While the present invention discloses the use of a plurality of manifold assemblies to implement its purposes, the spirit and scope of the present invention is to be limited only by the following claims.

What is claimed is:

1. A method for utilizing a multiple head bottle filling apparatus for filling bottles with liquid, the bottles segregated in respective, at least two differently sized trays, comprising the steps of:

(a) providing at least a first and second manifold assembly as part of the bottle filling apparatus, each said manifold assembly including a respective set of liquid discharging members, each discharging member having a respective opening for discharging liquid, each respective set of liquid discharging members in fixed relationship to each other of said set(s) of liquid discharging members, each said set of liquid discharging members' openings forming a respective grid pattern, and said bottle filling apparatus further including means for selectively supplying liquid to a respective one of said respective set of liquid discharging members, wherein the bottles to be filled in a respective one of the differently sized trays are positioned in said respective tray such that the fill openings to each of such bottles are aligned in a pattern corresponding to one of said respective grid patterns;

(b) positioning one such tray containing bottles in fixed relation to that one of said respective liquid discharging members, of that one of said at least said first and second manifold assembly, having said respective grid pattern corresponding to the bottle fill opening alignment pattern of the bottles;

(c) choosing and engaging the respective means for selectively supplying liquid to the liquid discharging members identified in step (a) to thereby fill the bottles in the tray through respective ones of said liquid discharging member openings; and, (d) repeating steps (b) and (c), as required, to fill successive trays of bottles, each of the fill openings to each of such bottles in each successive tray forming an alignment pattern corresponding to a respective grid pattern of one of said set of liquid discharging members.

2. The method according to claim 1 wherein said step of providing at least a first and second manifold assembly to said bottle filling apparatus further comprises using a quick-release manifold assembly holder to affix and detach said at least said first and second manifold assembly to said bottle filling apparatus.

3. The method according to claim 2 wherein said quick-release manifold holder is comprised of a first permanently affixed block secured to a back splash portion of said bottle filling apparatus, and a second block detachably connected to said first block, said first and second blocks being internally contoured to secure a corresponding portion of said at least said first and second manifold assembly when said second block is connected to said first block.

4. The method according to claim 1 wherein the respective openings for discharging liquid are at, substantially the same height above the corresponding fill openings of the bottles.

5. The method according to claim 1 wherein said step of choosing and engaging includes the step of manually positioning a valve portion of said means for selectively supplying liquid so as to permit the flow of liquid through said liquid discharging member openings into the bottles.

6. The method according to claim 1 wherein said step of choosing and engaging includes the step of activating a solenoid valve so as to permit the flow of liquid through said liquid discharging member openings into the bottles.

7. A multiple head bottle filling apparatus for filling bottles with liquid, the bottles segregated in respective, at least two differently sized trays, comprising:

(a) at least a first and second manifold assembly as part of the bottle filling apparatus, each said manifold assembly including a respective set of liquid discharging members, each discharging member having a respective opening for discharging liquid, each respective set of liquid discharging members in fixed relationship to each other of said set(s) of liquid discharging members, each said set of liquid discharging members' openings forming a respective grid pattern;

(b) means for selectively supplying liquid to a respective one of said respective set of liquid discharging members, wherein the bottles to be filled in a respective one of the differently sized trays are positioned in said respective tray such that the fill openings to each of such bottles are aligned in a pattern corresponding to one of said respective grid patterns;

(c) means for aligning individual ones of successive trays of bottles, wherein each of the fill openings to each of such bottles in each successive tray forms an alignment pattern corresponding to a respective grid pattern of one of said set of liquid discharging members; and, (d) means for selectively supplying liquid upon selection and enablement to the liquid discharging members identified in (a) to thereby fill the bottles in the tray through respective ones of said liquid discharging member openings.

8. The apparatus according to claim 7 further comprising a quick-release manifold assembly holder to affix and detach said at least said first and second manifold assembly to said bottle filling apparatus.

9. The apparatus according to claim 8 wherein said quick-release manifold holder is comprised of a first permanently affixed block secured to a back splash portion of said bottle filling apparatus, and a second block detachably connected to said first block, said first and second blocks being internally contoured to secure a corresponding portion of said at least said first and second manifold assembly when said second block is connected to said first block.

10. The apparatus according to claim 7 wherein the respective openings for discharging liquid are at substantially the same height above the corresponding fill openings of the bottles.

11. The apparatus according to claim 7 wherein said means for selectively supplying liquid includes a manually positionable valve so as to permit the flow of liquid through said liquid discharging member openings into the bottles.

12. The apparatus according to claim 7 wherein said means for selectively supplying liquid includes a solenoid valve automatically activated so as to permit the flow of liquid through said liquid discharging member openings into the bottles.

* * * * *